US007041943B2

(12) United States Patent
Michelmann

(10) Patent No.: US 7,041,943 B2
(45) Date of Patent: May 9, 2006

(54) ELECTRICAL HEATING ELEMENT FOR HEATING UNITS OF SEATS AND STEERING WHEELS

(75) Inventor: Jochen Michelmann, Gelnhausen (DE)

(73) Assignee: I G Bauerhin GmbH, (DE)

( * ) Notice: Subject to any disclaimer, the term of this patent is extended or adjusted under 35 U.S.C. 154(b) by 0 days.

(21) Appl. No.: 10/369,336

(22) Filed: Feb. 14, 2003

(65) Prior Publication Data

US 2003/0150850 A1 Aug. 14, 2003

(30) Foreign Application Priority Data

Feb. 14, 2002 (DE) ..... 102 06 336

(51) Int. Cl.
*H05B 3/34* (2006.01)

(52) U.S. Cl. ..... 219/545; 219/204; 219/529; 219/549

(58) Field of Classification Search ..... 219/545, 219/538, 546, 548, 552, 553, 217, 549, 230, 219/262, 126.2, 110 R, 211, 212, 204, 529; 338/262, 230; 174/126.2, 110 R
See application file for complete search history.

(56) References Cited

U.S. PATENT DOCUMENTS

| | | | | |
|---|---|---|---|---|
| 2,268,617 | A * | 1/1942 | Pierce | 72/47 |
| 2,317,350 | A * | 4/1943 | Adler et al. | 428/636 |
| 3,490,125 | A * | 1/1970 | Frieling, Jr. | 428/592 |
| 4,686,153 | A * | 8/1987 | Tominaga et al. | 428/610 |
| 4,810,593 | A * | 3/1989 | Yamamoto et al. | 428/677 |
| 4,889,215 | A | 12/1989 | Ohkanda | |
| 5,366,569 | A * | 11/1994 | Muller et al. | 148/525 |
| 5,407,741 | A * | 4/1995 | Ota | 428/323 |
| 5,483,931 | A | 1/1996 | Stoll et al. | |
| 5,484,983 | A * | 1/1996 | Roell | 219/545 |
| 5,704,993 | A * | 1/1998 | Zhou et al. | 148/96 |
| 5,845,757 | A | 12/1998 | Csonka | |
| 6,073,289 | A * | 6/2000 | Bolden et al. | 5/689 |
| 6,730,622 | B1 * | 5/2004 | Curro et al. | 442/336 |

FOREIGN PATENT DOCUMENTS

| | | |
|---|---|---|
| DE | 3726073 | 7/1988 |
| DE | 3832342 | 7/1989 |
| DE | 4101290 | 7/1992 |
| DE | 41 24 684 | 1/1993 |
| DE | 4125980 | 2/1993 |
| DE | 41 36 425 | 5/1993 |
| DE | 4138889 | 10/1993 |
| DE | 4321117 | 1/1995 |
| DE | 2760471 | 4/1996 |
| DE | 19707764 | 9/1997 |
| DE | 196 38 372 | 10/1999 |
| DE | 19630533 | 11/2000 |
| DE | 100 55 141 | 5/2002 |
| EP | 1 214 872 | 6/2002 |
| WO | WO 99/58829 | 11/1999 |

* cited by examiner

*Primary Examiner*—Robin O. Evans
*Assistant Examiner*—Vinod Patel
(74) *Attorney, Agent, or Firm*—Robert W Becker & Associates; Robert W Becker

(57) ABSTRACT

An electrical heating element for heating units of seats and steering wheels is provided. The heating element comprises at least one conductor having at least one core-coated wire that serves as a heat conductor and/or as a contact conductor and/or as a lead for temperature probes. The coating comprises steel and the core comprises copper or a copper alloy, or the coating comprises copper or a copper alloy and the core comprises steel.

12 Claims, 3 Drawing Sheets

ELECTRICAL HEATING ELEMENT FOR HEATING UNITS OF SEATS AND STEERING WHEELS

BACKGROUND OF THE INVENTION

The present invention relates to a heating element, a seat heating unit, a seat, a steering wheel, as well as to various applications.

To heat seats, especially in passenger vehicles, primarily tin-plated or silver-coated copper conductors are utilized. Despite this coating, as a function of environmental conditions these heat conductors exhibit the formation of corrosion, which is induced by moisture and the influence of salts. Due to this formation of corrosion, the heat conductors experience damaging reductions in cross-sectional areas, followed by localized overheating and finally to a breakage of the heat conductor, which results in a shortened service life of the heat conductor. Furthermore, the coating with silver or tin, or also other metals, increases the friction between the individual filaments of the heat conductor to such an extent that due to its increased rigidity, the heat conductor can become bent or broken, and thus can be severely damaged. A further drawback of a metallic coating of the individual heat conductor filaments is the greatly differing redox potential of the coating metals relative to the actual material of the wire. Where the coating is not free of pores, and gaps or defect areas are present, corrosion occurs under the influence of electrolytes formed of water and salt, and hence a dissolving or decomposition of the base metal, which in turn represents damage to the heat conductor. Finally, the mechanical requirements of such conductors in seats are very high, which in many cases cannot be satisfactorily realized.

DE 38 32 342 C1 discloses a coated wire having a surface of platinum that encases a core of an alloy of 1 to 5% by weight tungsten, with the remainder being platinum. This coated wire is preferably used as a lead wire for a resistance thermometer having a precision resistor of platinum.

DE 31 25 980 A1 discloses a wire-like semi-finished product for an electrical conductor wire having a specific maximum diameter that at least in the region of its free outer surface is comprised essentially of platinum, whereby the surface is coated with a gold coating, and whereby the core of the conductor wire can be comprised of nickel.

A drawback of such a product, among others, is the use of difficult to work materials as well as their high cost.

It is therefore an object of the present invention to provide an electrical heating element that avoids the aforementioned drawbacks, especially a heating element that can withstand the high mechanical stresses of an electrical heating unit in a seat, especially in a seat of a motor vehicle, and which at the same time has an outstanding electrical conductivity paired with a low susceptibility to corrosion and relatively low manufacturing costs.

BRIEF DESCRIPTION OF THE DRAWING

This object, and other objects and advantages of the present invention, will appear more clearly from the following specification in conjunction with the single FIGURE of the drawing, which is a schematic plan view of one exemplary embodiment of the inventive heating element.

SUMMARY OF THE INVENTION

Figure 1:
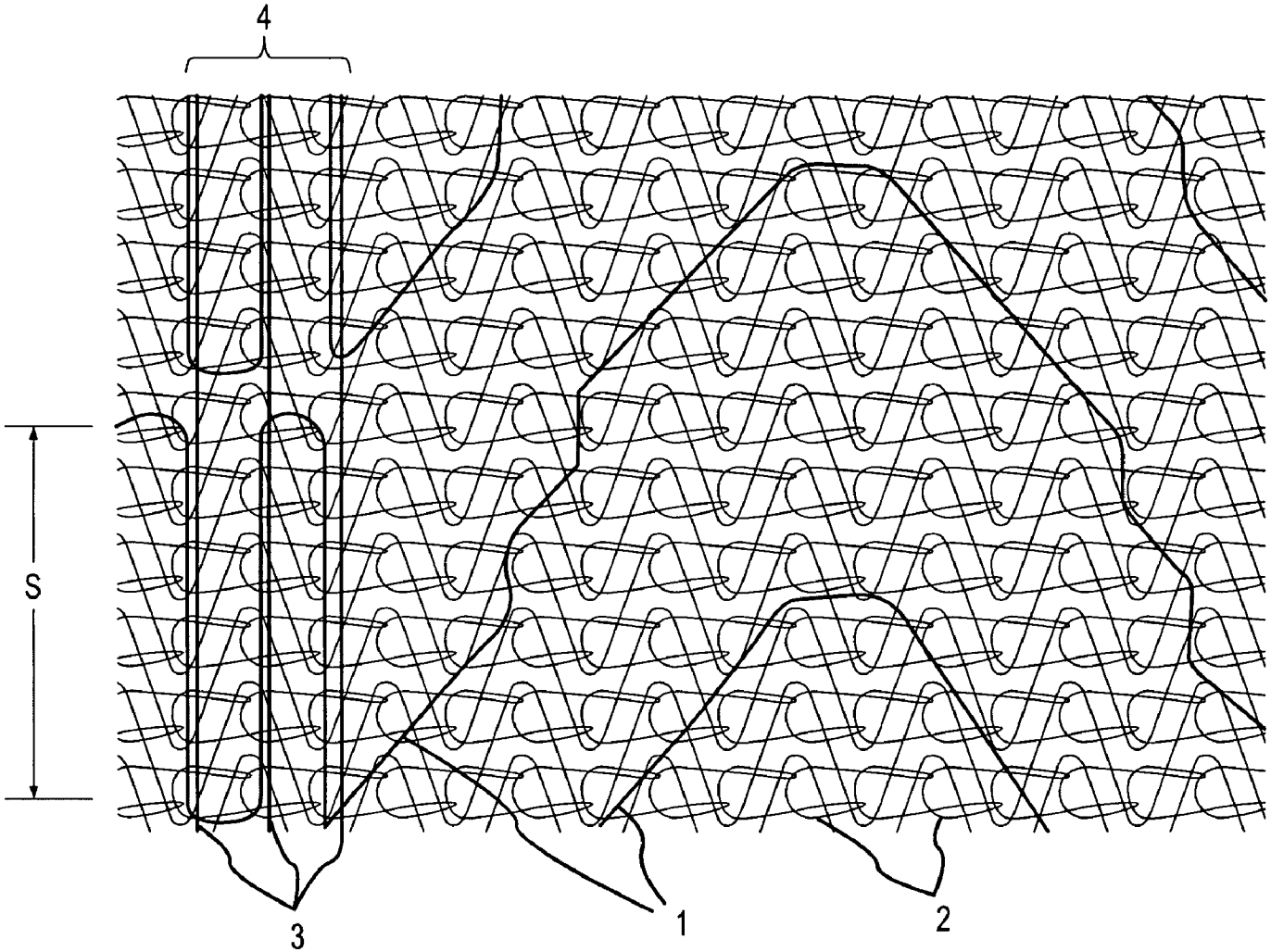
FIG. 1 is a plan view of one exemplary embodiment of the inventive heating element.

The object of the present invention is inventively realized by a unique heating element, a seat heating unit, a seat, a steering wheel, as well as specific applications, all as defined in the claims.

In particular, the inventive electrical heating element has at least one conductor having at least one core-coated wire, whereby the coating comprises steel and the core comprises copper or a copper alloy, or the coating comprises copper or a copper alloy and the core comprises steel. It is advantageous if the steel is a carbon-containing steel, since this has proven itself in practice.

Within the context of the present invention, a conductor comprises at least one conductor strand, which in turn is comprised of at least one wire, advantageously however of at least two wires.

Due to the special selection of materials, and the specific mechanical construction, the inventive wire has the above-indicated necessary characteristics to a large extent. The conductor can function as a heat conductor and/or as a contact conductor (for contacting the heat conductor, especially in meshes; in this regard see DE41 36 425 and DE 100 55 141) and/or has a lead for temperature probes (sensors, for example PTC and NTC elements). Especially when configured as a heat conductor, contact conductor and lead, a particularly economical and reliable embodiment is provided.

The following embodiments have shown themselves to be advantageous in practice.

The copper alloy contains copper and nickel, and/or the steel is a high-grade or stainless steel pursuant to DIN 4401. With this type of steel, it was surprisingly possible to achieve particularly long useful lives of many thousands of hours.

The copper alloy comprises 90–10% by weight copper and 10–90% by weight nickel.

The cross-sectional areas of the core and coating are in a ratio of 1:3 to 3:1.

The core and the coating can have at least approximately the same cross-sectional areas.

The diameter of the wire is in the range of 0.01 to 0.05 mm.

In order to provide a high protection against corrosion from external influences, the wire is provided with an outer electrical insulation. This insulation is preferably comprised of PTFE(polytetrafluoroethylene), FEP (copolymers of tetrafluoromethylene and hexafluoropropylene), MFA (perfluoroalkoxy polymer), or polyurethane lacquer.

The conductor contains at least one left-hand and at least one right-hand conductor strand in order to keep the inclination towards tension as low as possible and to be able to place the conductor in conformity with the requirements without axial coiling. This is particularly applicable for a plurality of conductor strands if the number of the left-hand and the right-hand conductor strands is the same.

The inventively utilized conductors customarily have one conductor strand up to about 100 conductor strands, whereby the conductor strands conventionally have one wire to about one hundred wires.

The conductor is secured in and/or on a carrier material, especially on a foam body and/or a mesh, in particular via a partial or short pick or weft (in the textile industry sense).

It should be noted that the ability to sew over the wire (again in the sense of the textile industry) has shown itself to be excellent.

The advantages described above are also applicable in an analogous manner for a seat heating unit, a seat, especially a motor vehicle seat, as well as an appropriate steering wheel, that contain an inventive heating element.

A further essential aspect of the present invention is the use of a conductor pursuant to the inventive heating element for the electrical connection of electrical heating elements, of seat components, that are separated by a terminal trench of a seat. At least one such conductor functions in this case as a bridge conductor (in other words, a highly flexible conductor between the two seat portions, the conductor functioning as a quasi "bridge"), that normally is electrically connectively soldered to the individual heating elements of the seat components.

Finally, the use of the above conductor as a heat conductor and/or contact conductor and/or lead of a temperature probe in heating elements, as well as for the heating of a steering wheel and/or seat, is inventive, since the high requirements of mechanical and electrical efficiency hereby placed upon the conductors are also fulfilled.

Also to be noted is the very advantageous use of the indicated conductor and the inventive heating element for the 42 volt power supply technology, since here a particularly high life expectancy over that which can be expected surprisingly results.

Although in this field serious problems have already existed for decades with regard to the mechanical strength and stability, satisfactory results have been obtained only with the present invention. The surprising thing is the combination of the materials and the relative arrangement to one another as core-coated material.

The term "terminal trenches" relates to cushioned seats of which an outer seat covering is pulled "inwardly" and is secured via an inner carrier frame. There results quasi a "trench" that in turn is spanned by two adjacent cushion wraparounds. The termination of the seat cover initially serves to avoid, with non-profiled seat coverings, possible deformations of the seat covering that might occur. The term "terminal trenches" is thus intended to signify the conventional terminology, with its appropriate semantical sense, in the field of cushioning of seats.

Further specific features of the present invention will be described in detail subsequently.

DESCRIPTION OF PREFERRED EMBODIMENTS

Figure 3:
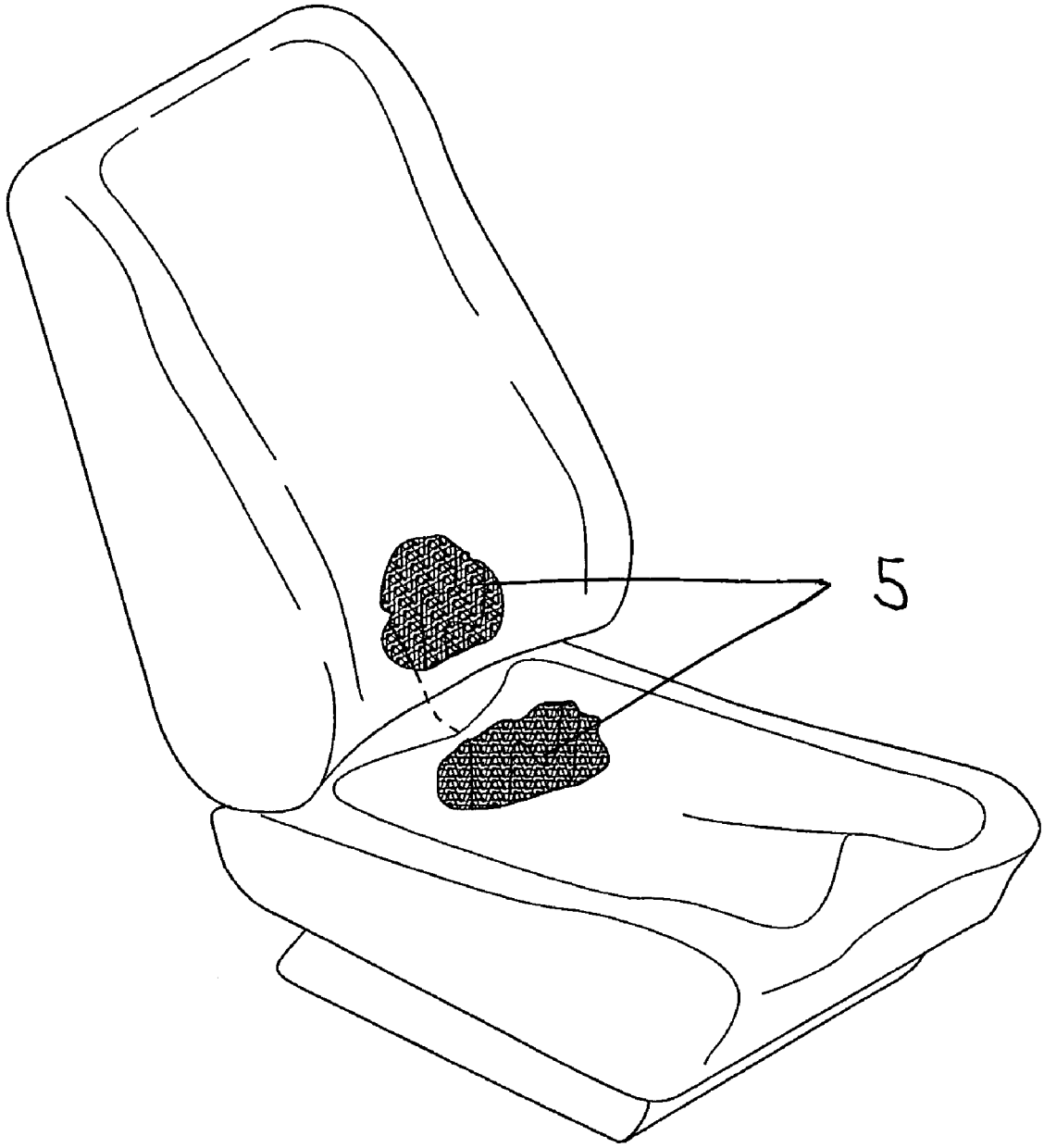
FIG. 3 shows the inventive electrical heating element in a seat, with the seat components being separated by a trench region.

Referring now to the drawing in detail, the exemplary heating element schematically shown therein essentially has a plurality of mesh filaments 2 that extend parallel and in which a heat conductor 1 is disposed in a sinusoidal manner. Three contact wires or conductors 3 that respectively extend parallel and convey current form a contact bank 4. Over a partial section S, the heat conductor 1 extends parallel to a contact conductor 3, crosses the adjacent contact conductor 3, and finally again extends parallel thereto; the heat conductors 1 and the contact conductors 3 are electrically interconnected. Sections 5 of the heating element are illustrated in a seat in FIG. 3.

Figure 2:
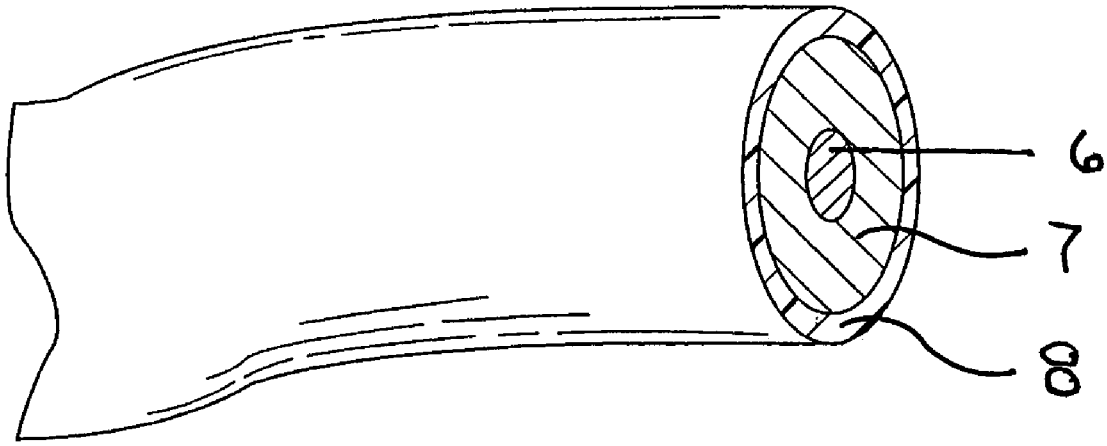
FIG. 2 is a cross-sectional view through a core-coded conductor wire having an insulation layer.

The heat conductors 1 and the contact conductors 3 are comprised of a plurality of conductor strands, which in turn are respectively comprised of seven core-coated wires. As shown in FIG. 2, the wires are provided with a core 6 of a high-grade or stainless steel pursuant to DIN 4401, and a coating 7 of copper, whereby the cross-sectional areas of the core and of the coating can be approximately the same. The wire can also be provided with an external electrical insulation 8.

The specification incorporates by reference the disclosure of German priority document DE 102 06 336.2 filed 14 Feb. 2002.

The present invention is, of course, in no way restricted to the specific disclosure of the specification and drawing, but also encompasses any modifications within the scope of the appended claims.

I claim:

1. An electrical heating element for heating units of seats and steering wheels, comprising:

at least one conductor having at least one core-coated wire that serves as at least one of a heat conductor, a contact conductor, and a lead of a temperature probe, wherein the coating of said wire comprises copper or a copper alloy and the core comprises steel, wherein said coating is disposed directly on said core, wherein said wire has a diameter of from 0.01 to 0.5 mm, and wherein said conductor is secured in and/or on a carrier material.

2. A heating element according to claim 1, wherein said steel is a carbon-containing steel.

3. A heating element according to claim 1, wherein at least one of the following applies:

said copper alloy contains copper and nickel, and said steel is a high-grade or stainless steel pursuant to DIN 4401.

4. A heating element according to claim 3, wherein said copper alloy comprises 90–10% by weight copper and 10–90% by weight nickel.

5. A heating element according to claim 1, wherein the ratio of the cross-sectional area of said core to the cross-sectional area of said coating is 1:3 to 3:1.

6. A heating element according to claim 5, wherein said core and said coating have at least approximately the same cross-sectional areas.

7. A heating element according to claim 1, wherein said wire is provided with an external electrical insulation.

8. A heating element according to claim 7, wherein said insulation is made of PTFE, FEP, MFA, or polyurethane lacquer.

9. A heating element according to claim 1, wherein said conductor contains at least one left-hand conductor strand and at least one right-hand conductor strand.

10. A heating element according to claim 9, wherein the number of left-hand conductor strands and the number of right-hand conductor strands are the same.

11. A heating element according to claim 1, wherein said carrier material is at least one of a foam body and a mesh.

12. A seat according to claim 1, wherein said seat is provided with seat components that are separated from one another by a trench, and wherein said seat components are electrically interconnected via at least one conductor pursuant to claim 1.

* * * * *